US012050095B2

(12) United States Patent
Plachy

(10) Patent No.: US 12,050,095 B2
(45) Date of Patent: Jul. 30, 2024

(54) ROTATIONALLY SYMMETRICAL LEAD MACHINE-TOOL TURNED PROJECTILE FOR GAS-GUNS

(71) Applicant: Altaros Air Solutions s.r.o., Liberec (CZ)

(72) Inventor: Ondrej Plachy, Liberec (CZ)

( * ) Notice: Subject to any disclaimer, the term of this patent is extended or adjusted under 35 U.S.C. 154(b) by 11 days.

(21) Appl. No.: 17/746,330

(22) Filed: May 17, 2022

(65) Prior Publication Data

US 2022/0276032 A1 Sep. 1, 2022

Related U.S. Application Data

(62) Division of application No. 16/946,735, filed on Jul. 2, 2020, now abandoned.

(51) Int. Cl.
*F42B 6/10* (2006.01)
*F42B 12/72* (2006.01)
*F42B 33/00* (2006.01)

(52) U.S. Cl.
CPC ..... *F42B 12/72* (2013.01); *F42B 6/10* (2013.01); *F42B 33/00* (2013.01)

(58) Field of Classification Search
CPC .... F42B 6/00; F42B 6/10; F42B 12/00; F42B 12/34; F42B 12/72; F42B 12/74; F42B 30/00; F42B 30/02; F42B 30/08; F42B 33/00
USPC ..... 86/51, 54; 102/501
See application file for complete search history.

(56) References Cited

U.S. PATENT DOCUMENTS

| | | | | |
|---|---|---|---|---|
| 296,958 | A | 4/1884 | Hebler | |
| 1,732,211 | A * | 10/1929 | Olin | B21K 1/025 102/514 |
| 1,769,263 | A * | 7/1930 | Johnson | B21K 1/025 428/572 |
| 2,868,130 | A | 6/1953 | Gulley | |
| 5,275,108 | A | 1/1994 | Chernicky | |
| 5,400,716 | A * | 3/1995 | Mayer | F42B 12/78 102/517 |
| 5,686,693 | A * | 11/1997 | Jakobsson | F42B 14/02 102/515 |
| 7,520,224 | B2 * | 4/2009 | Taylor | F42B 12/74 102/501 |
| 10,663,271 | B2 * | 5/2020 | Rogers | F42B 33/00 |
| 2021/0003374 | A1 * | 1/2021 | Plachy | F42B 12/72 |

* cited by examiner

*Primary Examiner* — James S Bergin
(74) *Attorney, Agent, or Firm* — CIONCA IP Law P.C.

(57) ABSTRACT

A rotationally symmetrical lead metal-cut projectile of the caliber ranging from 0.17 to 0.50 for gas-guns comprises at least 60% by weight of lead, up to 40% by weight of tin and up to 5% by weight of admixtures selected from the following list: Ag, As, Bi, Cd, Cu, Fe, Ni, Sb, Zn, Ti or their mixtures thereof.

4 Claims, 5 Drawing Sheets

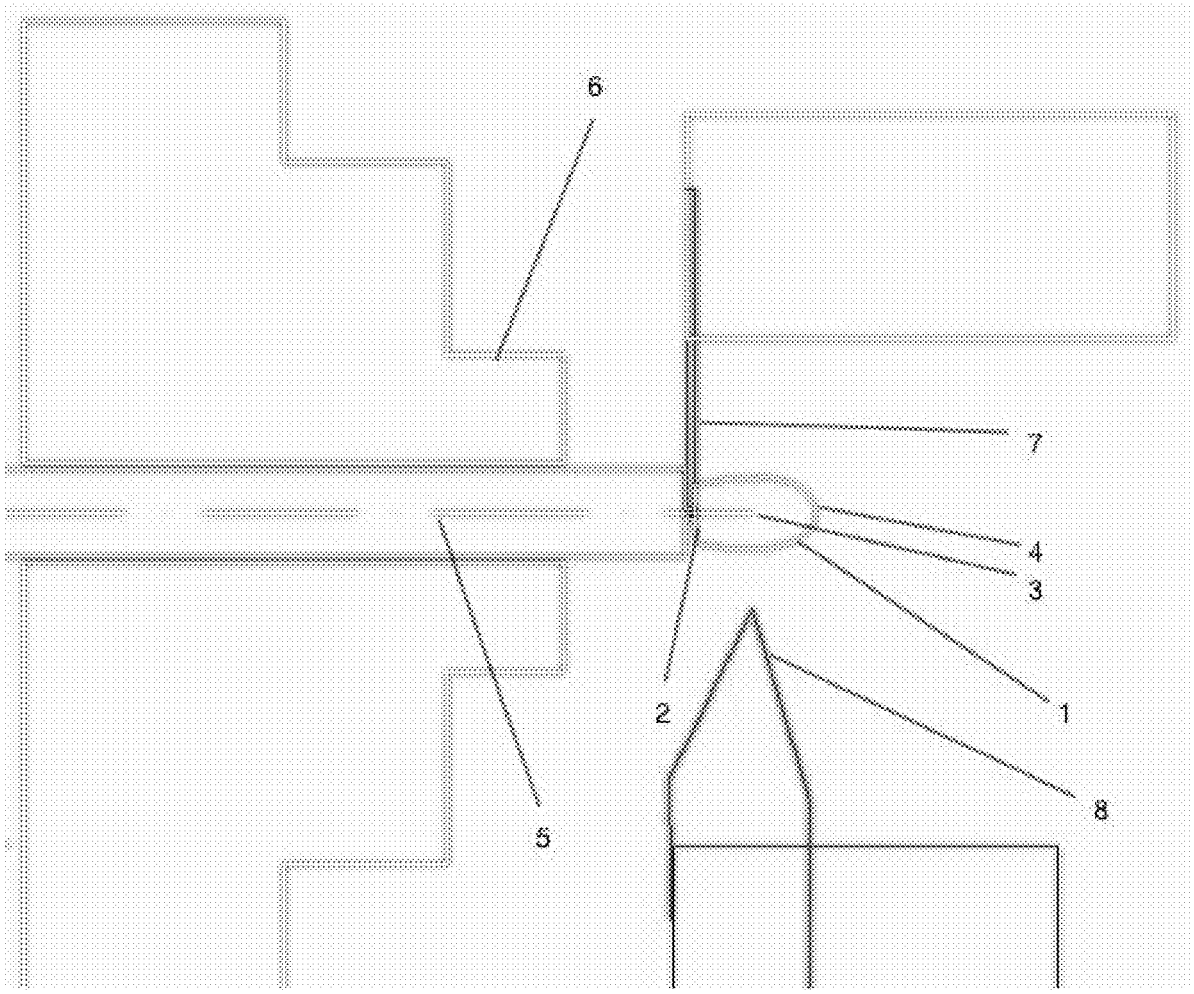
Fig. 6 - Prior Art

ROTATIONALLY SYMMETRICAL LEAD MACHINE-TOOL TURNED PROJECTILE FOR GAS-GUNS

CROSS-REFERENCE TO RELATED APPLICATIONS

This application is a divisional of U.S. Non-Provisional application Ser. No. 16/946,735, filed Jul. 2, 2020, which is hereby incorporated by reference, to the extent that it is not conflicting with the present application.

FIELD OF TECHNOLOGY

Gas-guns, air rifles, manufacture of bullets and projectiles

STATE OF THE ART

In the past, the widely accepted opinion was that lead is too soft to be turned on a lathe, i.e. by metal cutting. This opinion was based on a lack of good-quality materials that could shape such a soft metal on a lathe. Gradually, it turned out that also soft and non-ferrous metals, such as aluminium, brass, or copper, could be machined, provided that sufficiently hard and sharp cutters were used. Such cutters are usually manufactured from sintered carbide. Turnings of the material being machined do not adhere to such cutters and smooth surface finish can be obtained.

Soft metal cutting is covered by numerous articles comprehensible to the general public. Among the most widely used machines are NC or CNC. Soft metal cutting is mentioned, for example, in the article FACTORY AUTOMATION by Ing. Rostislav Svoboda: Co je to obráběcí centrum a co ta nejlepší CNC dokážou? (What does the term machining centre mean and what can be achieved with the best CNCs?), 17.1.2016, https://factoryautomation.cz/co-je-to-obrabeci-centrum-a-co-ta-nejlepsi-cnc-dokazou/. Suitability of non-ferrous alloys for machining is also discussed in the bachelor's thesis by "Bára Matušková: Obrobitelnost neželezných slitin (Suitability of Non-Ferrous Alloys for Machining), VSB Technical University of Ostrava, p. 30, 2018".

Regardless of the fact that high-quality metal-working machines have become widely available, only a few companies pursue the machining of soft metals. For example, in the Czech Republic, lead machining was carried out by only a single market operator, who is no longer present on the market. This means that currently there is no Czech market operator active in the machining of lead and its alloys on a commercial large-scale basis.

Compared to other firearms, gas-operated have their specifics. With gas-guns, the projectile is shot from the barrel due to the energy of compressed gas without an enormous increase of temperature in the barrel. On the other hand, firearms utilize the energy of ignited propellant powder to fire the projectile from the barrel, which results in an enormous increase of temperature in the barrel. Temperature in the barrel limits the selection of materials that can be used for the manufacture of projectiles/bullets. For example, lead with its melting temperature 327° C. cannot be used for projectiles in firearms without jacketing by a metal with a higher melting temperature. The manufacture of full metal jacket bullets is much more expensive than that of monometal and/or alloyed bullets, which is the reason why lead is rarely used for the manufacture of projectiles designed for firearms. However, among projectiles designed for firearms, brass or copper ones can be found as well. Some of them are manufactured by machining. For example, the American company Cutting Edge Bullets, https://cuttingedgebullets-.com manufactures monolithic copper turned bullets designed for firearms. It must be mentioned that the hardness of copper—hardness 3 as well as that of brass—hardness 3.5 to 4 is very different from that of lead—hardness 1.5. For this reason, attempts to machine small lead pieces of work often failed and up to this day it has been assumed that small lead objects cannot be subjected to metal cutting.

On the other hand, in gas-guns, lead plays an unsubstitutable role. Since time immemorial, lead pellets for gas-guns have been manufactured by casting lead and its alloys, and/or by pressing soft metals into moulds.

However, moulding and casting projectiles have a number of disadvantages related to the manufacturing process. The acquisition costs of the pressing or casting machines is about CZK 1 to 2 million, and the power demands related to the operation thereof are very high. Usually, such machines are powered by motors with input power in the order ranging from 2 to 5 kW. When new projectile prototypes are to be produced, a new casting or pressing mould must be manufactured. Such moulds are generally manufactured by external providers and their prices amount up to tens of thousands of CZK per mould. If it becomes evident that the prototype shape is not suitable, it is necessary to have a new mould manufactured, which considerably increases the price of the projectiles with new shapes. When the mould is suitable, it is put into production. However, considering the high pressures and conditions, the service life of the mould is count in the order of months. Then a new mould must be manufactured. The casting and pressing machines are very complex and their adjustment is not easy. Once the machine is adjusted for one type and/or shape of projectiles, transition to a different type of projectile, including the change of the casting/pressing mould takes up to several tens of minutes, which increases the costs of production in a not negligible manner. With extruded projectiles, i.e. projectiles pressed without the mould cut open, projectiles with groves cannot be manufactured. When projectiles are pressed in double-deck moulds, groves can be manufactured.

Series production of pellets for gas-guns is based, in particular, on lead and copper- and -zinc alloys. Although the copper-and-zinc alloys are harder, they are lighter than lead, which means that the ballistic efficiency of the pellets made from them are no so good as those of lead pellets.

Ballistic coefficient significantly affects the conservation of speed of the shot projectile, which corresponds to the energy of the projectile during its motion. The higher the projectile speed, the higher its residual energy at the target. This is a very important and often the most important factor concerning the projectile, in particular from the point of view of hunters, as gas-guns are used for hunting worldwide very often. The currently manufactured projectiles attain the value of ballistic coefficient (BC) about 0.079, depending on their weight.

Since 2017, the gas-guns sector began to develop. In addition to the development of new gas-guns with higher power, the diversion of projectiles from captive and usually used pellets or pellet-type projectiles is also being considered. The development of new projectiles for gas-guns is still in its infancy. However, all current projectiles for gas—guns still maintain the cylindrical shape of the projectiles. The shape of the cylinder is advantageous mainly due to the production of compression projectiles, where the material is pressed into the cylinder mold and again extruded from the mold in the opposite direction. This is also the reason why current projectiles are made with a depression at the projectile face—at the location of the depression, the projectile is extruded from the mold and the depression minimizes damage of the outer shape of the projectile. The presence of the depression may be advantageous for hunting projectiles due to the expansion of the projectile upon impact. On the other hand, the aerodynamics of a projectile with a depression on the face deteriorates rapidly, the projectile is braked by air and is not suitable for shooting at long distances Such pellet-type projectiles represent Slug-type projectiles, the most common projectiles for gas-guns, such as Air Slug Nielsen, Air Slug HaN or JSB Knock Out Slugs. No other types of projectiles other than the pellet-type are on the market, so there is currently no sufficient comparison for the projectiles according to this invention and none of the prior art teaches or suggests to make projectiles according to this invention.

The mass-produced projectiles always show minor deviations from the standard, usually up to 10%, caused by the casting or pressing process itself, the non-homogeneous cooling of metal in the mould or a leaking mould resulting in flawed bonds on the projectile. In the past, such minor deviations were not a hindrance as the gas-guns themselves, such as air guns/rifles, were manufactured with a relatively considerable lack of precision. Gradually, gas-guns have been developed and become more precise, with their inner shooting mechanism gradually getting its current form when gas-guns are the full-valued substitutes for firearms in terms of precision within several hundreds of meters. With the present-day gas-guns, requirements imposed on projectiles are much stricter than those expected from air guns/rifles. Every deviation in the projectile results in a deviation when hitting the target, which is undesirable in particular with sporting or hunting rifles.

It has been proven that with shots at the target at a distance exceeding 300 m, a deviation of the lead cast projectile when hitting the target is up to 10 cm. With shots at the target at a distance exceeding 800 m, a deviation of the lead cast projectile when hitting the target is up to 50 cm.

This means that no projectile made of lead allowing the precision of monolithic metal-cut bullets to be obtained is available. In the situation where a new generation of air riffle is being launched on the market, with no loss-making expansion space and with parameters dramatically exceeding those of the standard rifles in which standard cast or pressed lead diabolo pellets are used, it is desirable to develop new bullets designed for the new rifle that would be able to attain a high precision of the projectile during the rifle shot.

DESCRIPTION OF THE INVENTION

Machine-tool turned projectiles made of lead or its alloys with a deviation from the design-based diameter of the projectile less than 1%, preferably 0.5%, which significantly contributes, together with lead density, to an increase of the ballistic coefficient value compared to pressed and cast projectiles, have been developed.

Ballistic coefficient significantly affects the conservation of speed of the shot projectile, which corresponds to the energy of the projectile during its motion. The higher the projectile speed, the higher its residual energy at the target. This is a very important and often the most important factor concerning the projectile, in particular from the point of view of hunters, as gas-guns are used for hunting worldwide very often.

For example, with the caliber of 5.5 mm, a deviation less than 0.005 mm, i.e. less than 0.1%, has been attained. With shots at the target at a distance of up to 200 m, a deviation of the turned projectile when hitting the target is less than 6 cm. With shots at the target at a distance of up to 500 m, a deviation of the turned projectile when hitting the target is less than 25 cm. With a lead turned projectile with the caliber of 5.5 mm according to Example 2, even the world record was attained when the target of the size of 56×46 cm was hit at a distance of 1,280 m.

Rotational machine-tool turning utilizing cutters with carbide plates or plates made of high-speed steel of class 19 as per CSN in a machine-tool, advantageously NC or CNC machine have been used. The turning bar was made of pure lead or lead alloys; either the bar and/or the cutters may rotate. The external shape of the projectile being manufactured is given by the movement of the cutter and/or the bar along a defined path in space by which excessive material from the bar is removed thus creating the desired shape. The excessive material in the form of turnings is removed from the final shape of the projectile and finally, the worked projectile is separated from the bar by a cut-off tool. The manufacture of one projectile is thus finished, the bar is mechanically moved and the process is repeated for the next projectile. The entire process is continual and does not require the operator's interventions. One projectile is preferably manufactured in one position of the bar, which means that during working, the bar is not moved in jumps but only rotates. Projectiles longer than 3 cm and projectiles with the caliber of 45 and larger are preferably manufactured in two steps where in step one the bar is worked to create a rough shape of the projectile with the final shaping of the projectile performed during step two.

In addition to smooth-surface working, separation of the worked projectile from the bar is the key step of the manufacture of lead projectiles made by rotational metal cutting. It is desirable that no damage be caused by separation with no or at least minimized residual trace on the projectile. The residual trace on the projectile forms in the final phase of the projectile manufacture; often no sooner than during its separation from the bar. With the decreasing diameter of the material that holds the projectile and the bar together, the projectile tends to break off before its perfect separation is completed. Cut-off tools thicker that 1.5 mm cause higher wastage of material and also misalignment of the projectile being separated, its spontaneous breaking off and the formation of an undesirable trace. Cut-off tools thinner than 0.4 mm are fragile and do live up to the required service life. The ideal cut-off tool has proven to have the thickness ranging from 0.8 to 1.2 mm.

Therefore, the separation of the worked projectile must be done as quickly as possible with the least cutting forces to separate the finished projectile from the bar before it breaks off due to its dead weight and centrifugal force. Preferably, a cut-off tool with a carbide plate or with a plate made of high-speed steel of class 19 as per ČSN should be used.

Preferably, the bar rotates along its central axis and is static in the axes x and y, i.e. it does not move forward, backward or sideward. The cutter(s) is/are moving in the axis x as well as y in a single plane only where the central axis of the bar is found in this plane. This means that the cutter(s) move(s) forward, backward as well as sideward, more specifically into the depth of the rotating bar that is thus being shaped. The cutter approaches the bar based on programmed coordinates.

In a different embodiment, the bar moves during rotation along its central axis x and the bar also moves along the axis x, meaning forward and backward. The cutter(s) move(s) either along the axis x as well as y, meaning that they move forward as well as backward and into the depth of the rotating bar. Alternatively, the cutter moves only along the axis Y, meaning into the depth of the rotating and moving bar. Based on programmed coordinates, the rotating bar is moved, usually only along its central axis x.

As it was mentioned in the introductory part, the worked lead projectiles have a higher value of ballistic coefficient compared to corresponding pressed or cast lead projectiles. Specific comparison is provided in Examples 1, 2, and 3, where the value of ballistic coefficient was measured. Generally, it is possible to say that worked lead projectiles attain up to a 3.3-fold higher value of ballistic coefficient than that attained by the standard pressed projectiles available on the market. An increased value of ballistic coefficient results in a better stability of the shot projectile and in a reduction of the side deviation of the shot projectile caused by side wind. The weight of the projectile and/or the density of the used material affect the value of ballistic coefficient. The higher the density, the higher the ballistic coefficient and the lower the effects of side wind on the shot projectile. Lead has been selected as a basic material just for these reasons. In addition, brass rotationally turned projectiles have been manufactured, and, surprisingly, the values of ballistic coefficients of the brass worked projectiles were not nearly as good as those of the lead projectiles. Regardless of the high precision of the worked projectiles, the low density of brass resulted in a reduced value of ballistic coefficient. Therefore, the manufacture of all-brass projectiles was given up. Nevertheless, one of the optimal variants discovered was a lead alloy comprising up to 40% by weight of tin. Preferably, lead or an alloy of lead and tin also comprises a minor quantity of Ag, As, Bi, Cd, Cu, Fe, Ni, Sn, Zn, and/or Ti.

For the manufacture of turned projectiles, the following was selected:

- alloys of lead and admixtures, such as Ag, As, Bi, Cd, Cu, Fe, Ni, Sb, Zn, and/or Ti, where the alloy comprised at least 95% by weight of lead; the alloy preferably comprises at least 98.5% by weight of lead and up to 1.5% by weight of admixtures; or
- alloys of lead and tin, where the alloy comprised at least 60% by weight of lead, up to 40% by weight of tin; preferably, the alloy of lead and tin also comprises up to 5% by weight of Ag, As, Bi, Cd, Cu, Fe, Ni, Sb, Zn, and/or Ti, in which case tin in the alloy amounts up to 35% by weight, antimony (Sb) is preferably added to alloys in the quantity of up to 5% by weight to improve the chemical properties of the alloys and increase their hardness.

The shapes of projectiles are not limited in any manner but preferably, the projectile should have a flat back and a rounded or pointed front. Preferably, the diameter of the projectile at the back is smaller than the diameter of the projectile in its central part. In another embodiment, it is preferred when the projectile has a shape evenly narrowing from the centre of the projectile towards its face or when the length of the projectile is greater than the projectile diameter.

Preferably, the projectile is fitted with at least one groove situated perpendicularly to the central axis of the projectile. The grooves on the bullet allow friction in the barrel to be reduced, which results in the fact that if a lead projectile with grooves as that provided for example in Example 1 is shot from the same gas-operated firearm as a similar pressed lead projectile without grooves, its muzzle energy is higher. The difference between the values of muzzle energy can be up to 20%.

Another advantage of the turned projectiles is speed and price of their manufacture, including the speed of the manufacture of prototypes. When new shapes of projectiles are developed, the prototype takes units of minutes to manufacture—only by programming/designing the required shape in the metal-working machine system. During 8 working hours, up to 100 pieces of various prototypes can be manufactured. If it is necessary to slightly adapt the prototype, only the shape programmed in the metal-working machine system is adapted. In addition, it is possible during production to quickly switch between different shapes of projectiles—again by mere changing the shape downloaded to the system of the metal-cutting machine. Another significant advantage compared to the conventional manufacture of projectiles is the minimum wear of the tools and/or their quick and cheap replacement. Metal-cutting tools made of carbide or high-speed steel are designed for non-ferrous metals, such as copper or brass, meaning materials harder than lead and its alloys used for the lead turned projectiles according to the present invention. Therefore, the wear of the cutters is absolutely minimal and their minimal service life has been determined empirically in the order of units of years. This fact is closely related to economic advantages of lead rotationally turned projectiles where in addition to savings concerning materials for the manufacturing equipment where no investment in expensive casting or pressing moulds, the service life of which is in the order of months, is required, also significant savings related to the operation of the manufacturing equipment was realized. Energy demands on the part of the metal-cutting machine are totally negligible compared to those required by the pressing and casting machines and the acquisition price of the metal-cutting machine is approximately 10 times lower compared to that of the pressing or casting machine.

A Summary of the Invention

A rotationally symmetrical lead machine-tool turned projectile of the caliber of .17 up to 0.50 for gas-guns comprises at least 60% by weight of lead, up to 40% by weight of tin and up to 5% by weight of admixtures—Ag, As, Bi, Cd, Cu, Fe, Ni, Sb, Zn, and/or Ti.

Preferably, the projectile comprises at least 95% by weight of lead.

Preferably, the projectile is equipped with at least one groove perpendicular to the central axis of the projectile.

Preferably, the projectile is equipped with a flat back.

Preferably, the diameter of the projectile at the back is smaller than the diameter of the projectile in its central part.

Preferably, the projectile has a shape evenly narrowing from the centre of the projectile towards its face.

Preferably, the length of the projectile is greater than the diameter of the projectile. The method of manufacture of the rotationally symmetrical lead turned projectile is realized as follows: the bar made of lead alloy comprising at least 60% by weight of lead is clamped into a collet on the mandrel of the machine-tool or metal cutting machine; on the cutter support of the machine, the cutter and cut-off tool are clamped, the machine is programmed the metal-cutting curve and the machine is started; the bar is worked by the cutter as per the metal-cutting curve and the worked projectile is separated in the point of the flat back by the cut-off tool.

Preferably, the cutter and/or cut-off tool has a carbide blade or a blade made of high-speed steel of class 19 as per ČSN.

Preferably, the bar rotates around its central axis and the cutter moves in a single plane and the central axis of the bar is part of the plane.

Preferably, the cut-off blade has the thickness of the blade ranging from 0.4 to 1.5 mm.

The invention overcomes a technical prejudice. Rotationally metal-cut bullets are manufactured for firearms only. Precision attained by gas-guns is not such to justify the manufacture of bullets by rotational metal-cutting. The bullets were only cast or pressed and the need for making bullets designed for air rifles more precise did not exist and therefore was not addressed. With the new generation of air rifle being put on the market, the situation has changed and lead turned projectiles will find their application in these rifles.

BRIEF DESCRIPTION OF THE DRAWINGS

FIG. 6 (Prior Art): A schematic diagram of a programmable machine tool for cutting.

EXAMPLES OF INVENTION EXECUTION

Example 1A

A total of 28 rotationally metal-cut projectiles of the caliber 0.22, i.e. 5.5 mm, for gas-guns were manufactured with the standard deviation of diameter ±0.005 mm, with the length 9.4 mm, with the standard deviation of length ±0.02 mm, with the weight per projectile 2.02 g, with the standard deviation of weight ±0.0015 g.

Figure 1A:
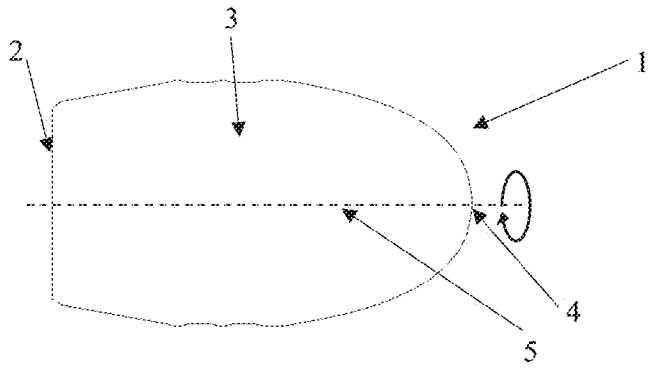
FIG. 1A: A lead turned projectile 1 according to Example 1 with two grooves is presented. The turned projectile 1 has a flat back 2, where diameter of flat back 2 is smaller than diameter of centre 3 of the projectile 1. The projectile 1 has a rounded face 4. A central axis 5 of the projectile 1 is showed.

A bar with the length of 300 mm and with the diameter of 6 mm made of lead alloy comprising 99.8% by weight of lead and 0.2% by weight of antimony was clamped into a collet on the mandrel of the CNC machine. The CNC machine was adjusted as follows: the revolutions of the mandrel were set at 2,200 revolutions per minute and the advance movement of metal-cutting was 170 mm/min. The metal-cutting process was programmed based on the curve provided in FIG. 1A.

An exemplary programmable machine tool is depicted by the schematic diagram of FIG. 6. FIG. 6 shows a collet (6) on a mandrel (5) of the machine tool, a cut-off tool (7), a cutter support (8) for cutting a projectile (1) having a rounded face (4) and flat back (2).

A cutter with a carbide plate and a cut-off blade made of high-speed steel with the blade thickness of 0.8 mm were fixed to the cutter support on the CNC machine. Then the CNC machine was started and the bar began to be metal-cut along the set path of the cutter, and/or the required shape of the projectile. After the first projectile was metal-cut, the projectile was separated from the bar by the cut-off tool. The projectile was then removed from the metal-cutting space and the process was repeated for the following projectile: the bar clamped in the CNC machine was moved forward by the length of the separated metal-cut projectile and the metal-cutting of the bar repeated with the next projectile.

Figure 1B:
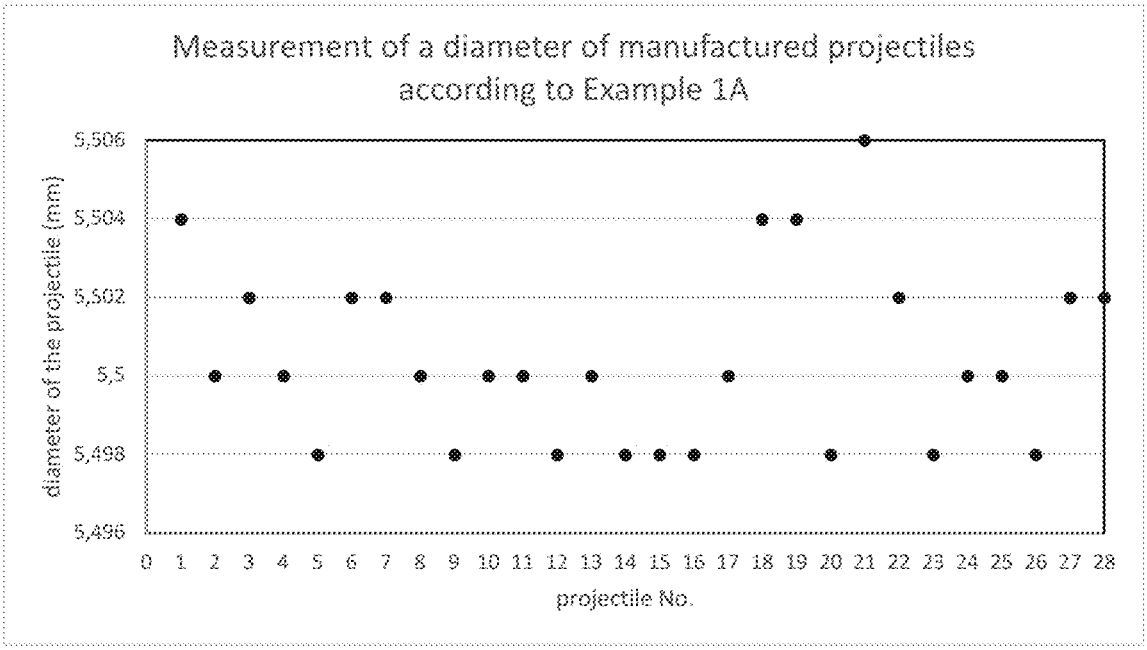
FIG. 1B: Measurement of diameters of the projectiles according to Example 1A. The graph shows the variance of the measurements of the individual turned projectiles machined.
Figure 1C:
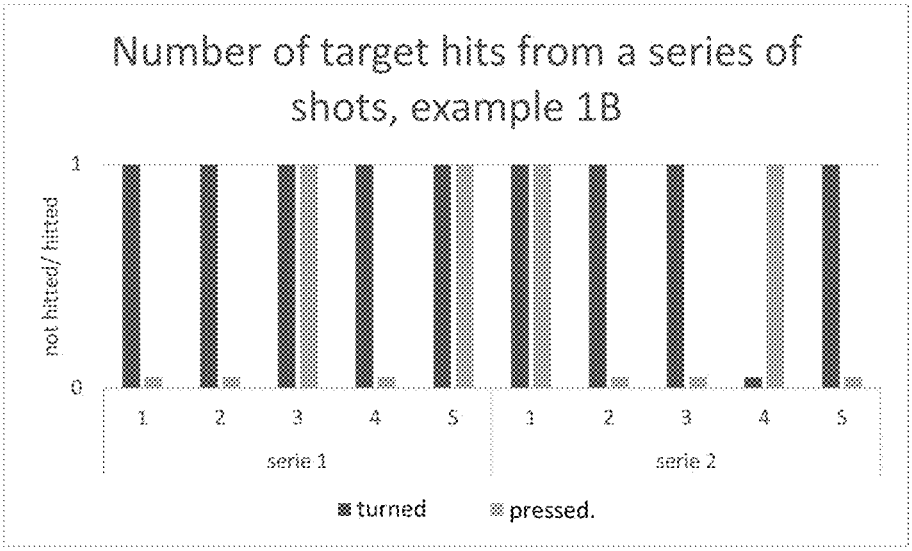
FIG. 1C: Number of target hits of a series of shots according to Example 1B. There is a clear comparation between lead turned projectiles according to this invention and projectiles from the state of the art.

A total of 28 lead rotationally metal-cut projectiles were manufactured from the bar with the length of 300 mm. All projectiles were automatically measured with a measuring tool with the accuracy of 2 μm. All projectiles that were manufactured with the required tolerance ±0.005 mm, i.e. ±0.09% of diameter, were included in the compliant series. Projectiles whose measured deviations were higher, were discarded. In this specific production run, none projectile was discarded, which means that 28 projectiles were included in the series. The measurement is provided in FIG. 1B.

Example 1B

Use of the Projectile According to Example 1A

The projectiles according to Example 1A were used for firing at a distance of 205 m, where lead projectiles pressed according to the state of the art, Airgun Slugs Nielsen cal. 5.5 mm, weight 27.5 grain, which corresponds 1.78 g and lead projectiles according to the present invention were compared. To compare the projectiles, one shooter with the same gas-operated weapon, the same target, the same distance and identical weather conditions were ensured. The target has a circular profile with the diameter of 6 cm; two series of five shots, i.e. 2×5 shots, were fired. The lead metal-cut projectiles as per Example 1A in the first series achieved 5 hits out of 5 shots, i.e. 100%, while in the second series it was 4 hits out of 5 shots, i.e. 80%. The tested pressed projectiles according to the state of the art in the first series achieved 2 hits out of 5 shots, i.e. 40%, and in the second series it was again 2 hits out of 5 shots, i.e. 40% as well.

A significant benefit of the lead metal-cut projectiles was in particular the considerably higher measured value of ballistic coefficient BC=0.149. The manufacturer of the pressed projectiles according to the state of the art provides BC=0.079. The significantly higher value of ballistic coefficient of the metal-cut projectiles ensured nearly half the value of side deviation with the same acting force of side wind.

Another advantage of the metal-cut projectiles compared to the pressed ones was their weight and dimensional stability. It ensured the very low standard deviation of the lead metal-cut muzzle speed being ±0.2 m/s, which caused a height deviation of ±0.44 cm from the aiming point on the target. The used pressed projectiles according to the state of the art attained the standard deviation of muzzle speed ±0.9 m/s, which caused a difference in height on the target ±2.15 cm from the aiming point. Both projectiles were fired at the same speed of 279 m/s.

The lead rotationally metal-cut projectiles thus provided the shooter with a greater shooting error without missing the target compared to the pressed lead projectiles whose parameters provided practically no space for the shooter's error resulting in missing the target.

Example 2A

A total of 14 rotationally metal-cut projectiles of the caliber 0.22, i.e. 5.5 mm, for gas-guns were manufactured with the standard deviation of diameter ±0.005 mm, with the length 20.2 mm, with the standard deviation of length ±0.02 mm, with the weight per projectile 4.02 g, with the standard deviation of weight ±0.0018 g.

Figure 2A:
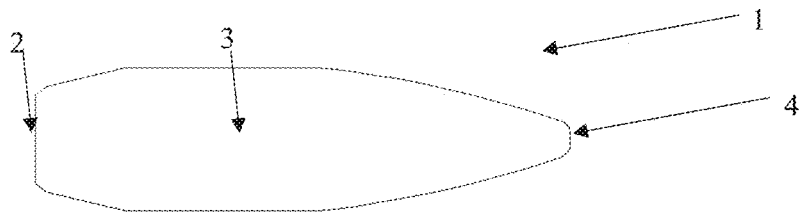
FIG. 2A: A lead turned projectile 1 according to Example 2A of a bent type with a pointed face 4 and flat back 2, where diameter of flat back 2 is smaller than diameter of a centre 3 of the projectile 1.

Following manufacture, a bar with the length of 300 mm and with the diameter of 6 mm made of lead alloy comprising 99.96% by weight of lead and 0.04% by weight of non-specified admixtures was clamped into a collet on the mandrel of the CNC machine. The CNC machine was adjusted as follows: the revolutions of the mandrel were set at 2,200 revolutions per minute and the advance movement of metal-cutting was 170 mm/min. The metal-cutting process was programmed based on the curve provided in FIG. 2A.

A cutter with a carbide plate and a cut-off blade made of high-speed steel with the blade thickness of 0.8 mm were fixed to the cutter support on the CNC machine. Then the CNC machine was started and the bar began to be metal-cut along the set path of the cutter, and/or the required shape of the projectile. After the first projectile was metal-cut, the projectile was separated from the bar by the cut-off tool. The projectile was then removed from the metal-cutting space and the process was repeated for the following projectile: the bar clamped in the CNC machine was moved forward by the length of the separated metal-cut projectile and the metal-cutting of the bar repeated with the next projectile.

Figure 2B:
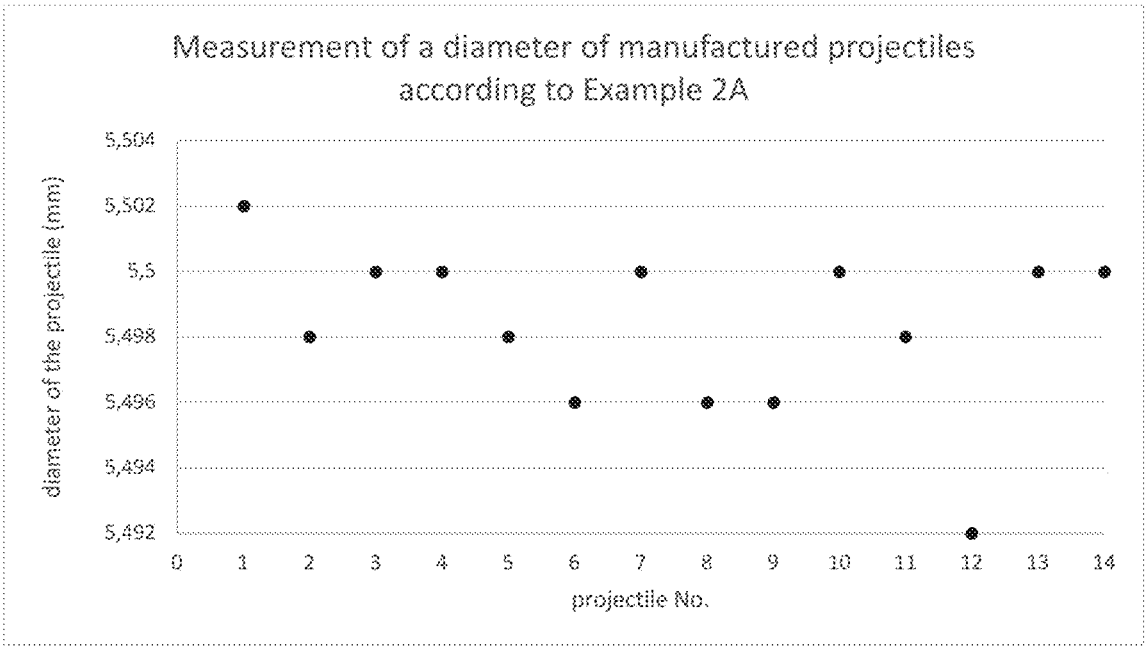
FIG. 2B: Measurement of diameters of the projectiles according to Example 2A. The graph shows the variance of the measurements of the individual turned projectiles machined.

A total of 14 lead projectiles were manufactured from the bar with the length of 300 mm. All projectiles were automatically measured with a measuring tool with the accuracy of 2 μm. All projectiles that were manufactured with the required tolerance ±0.005 mm, i.e. ±0.09% of diameter, were included in the compliant series. Projectiles whose measured deviations were higher, were discarded. In this specific production run, none projectile was discarded, which means that 14 projectiles were included in the series. The measurement is provided in FIG. 2B.

Example 2B

Use of the Projectile According to Example 2A—the World Record

The projectiles according to Example 2A were used for firing at a distance of 1,280 m, where lead projectiles pressed according to the state of the art, Airgun Slugs H&N, cal. 5.5 mm, weight 30 grain, which correspond 1.94 g and lead rotationally metal-cut projectiles according to the present invention were compared. To compare the projectiles, one shooter with the same gas-operated weapon, the same target, the same distance and identical weather conditions were ensured. The target had the shape of a rectangle with the size of 56×46 cm; a total of 6 shots were fired. The lead metal-cut projectiles according to Example 2A allowed the said target to be hit at this distance by the sixth shot, i.e. by 1 shot out of 6. The tested pressed projectiles do not achieve satisfactory ballistic parameters allowing the target to be hit at this distance—it is not physically possible to take aim as the drop of projectiles is out of the scope of the projectile aiming system.

A significant benefit of the lead metal-cut bullets was in particular the considerably higher measured value of ballistic coefficient BC=0.266. The lead pressed projectiles according to the state of the art only achieved the value of the ballistic coefficient BC=0.079. The significantly higher ballistic coefficient of the lead metal-cut projectiles ensured nearly 3.5 times lower side deviation with the same acting force of side wind. In addition, lead metal-cut projectiles have a significantly lower drop in muzzle speed during motion, by which the ballistic curve is improved—flattened.

Another advantage of the metal-cut projectiles compared to pressed ones was the weight and dimensional stability which ensured a very low measured standard deviation of the projectile muzzle ±0.3 m/s, that resulted in a height deviation from the aiming point of only 5 cm.

Example 3A

A total of 17 rotationally metal-cut projectiles of the caliber 0.22, i.e. 5.5 mm, for gas-guns were manufactured with the standard deviation of diameter ±0.005 mm, with the length 16.7 mm, with the standard deviation of length ±0.02 mm, with the weight per projectile 3.13 g, with the standard deviation of weight ±0.0017 g.

Figure 3A:
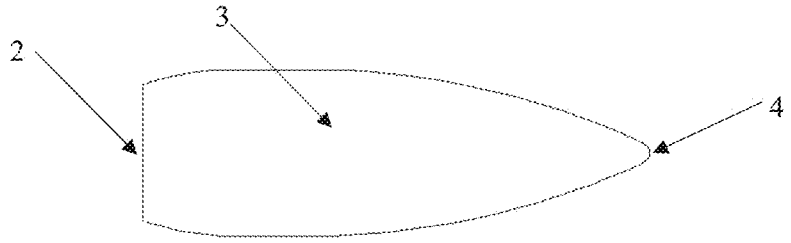
FIG. 3A: A lead turned projectile 1 according to Example 3A, of a round type with a pointed face 4 and a flat back 2, where diameter of flat back 2 is smaller than diameter of a centre 3 of the projectile 1.
Figure 3B:
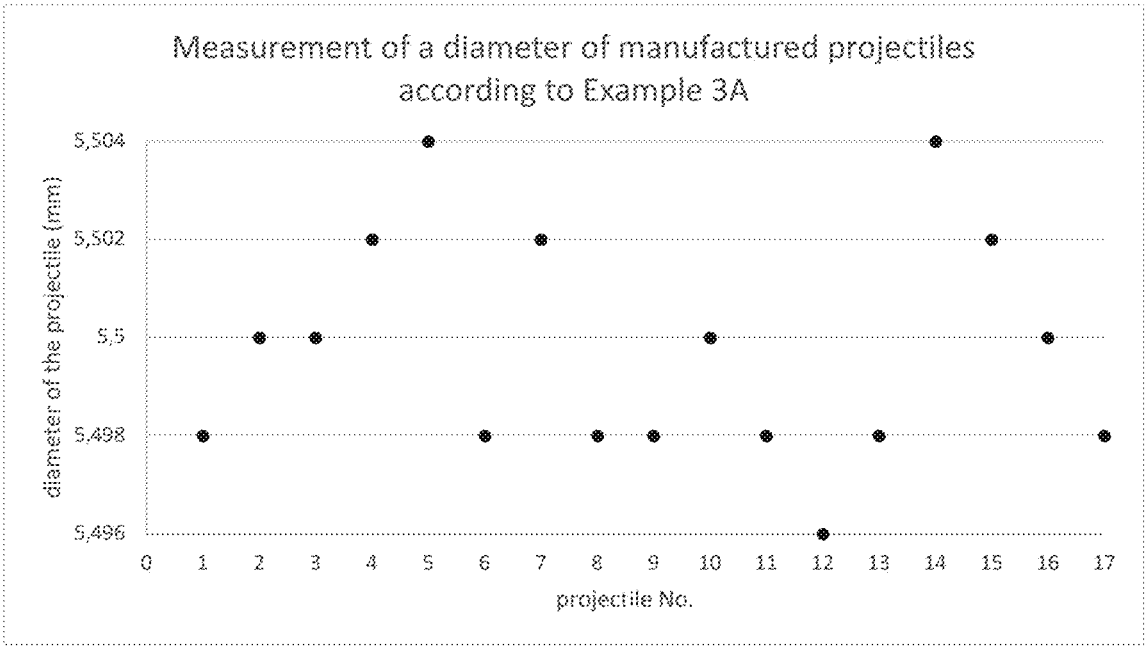
FIG. 3B: Measurement of diameters of the projectiles according to Example 3A. The graph shows the variance of the measurements of the individual turned projectiles machined.
Figure 3C:
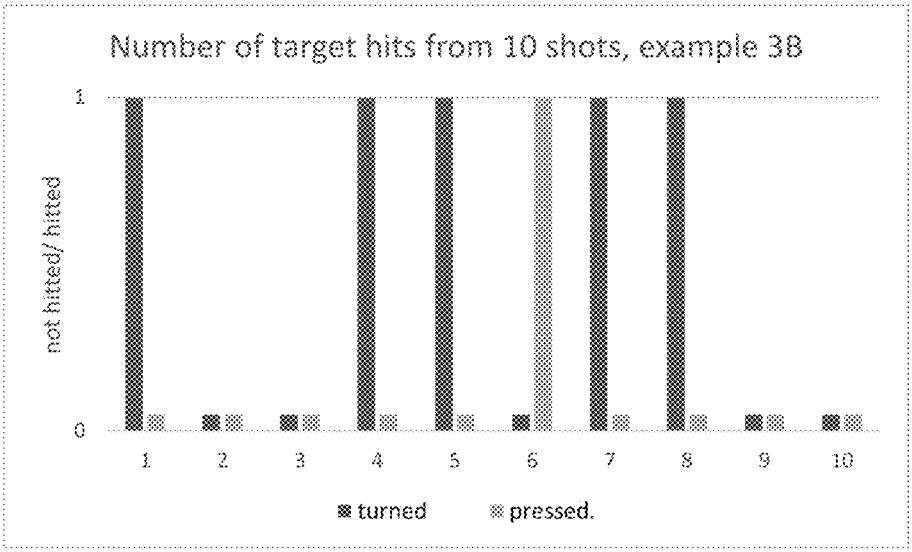
FIG. 3C: Number of target hits of 10 shots according to Example 3B. There is a clear comparation between lead turned projectiles according to this invention and projectiles from the state of the art.

A bar with the length of 300 mm and with the diameter of 6 mm made of lead alloy comprising 95% by weight of lead and 5% by weight of antimony was clamped into a collet on the mandrel of the NC machine. The NC machine was adjusted as follows: the revolutions of the mandrel were set at 1800 revolutions per minute and the advance movement of metal-cutting was 110 mm/min. The metal-cutting process was programmed based on the curve provided in FIG. 3.

A cutter with a carbide plate and a cut-off blade made of carbide with the blade thickness of 0.6 mm were fixed to the cutter support on the CNC machine. Then the CNC machine was started and the bar began to be metal-cut along the set path of the cutter, and/or the required shape of the projectile. After the first projectile was metal-cut, the projectile was separated from the bar by the cut-off tool. The projectile was then removed from the metal-cutting space and the process was repeated for the following projectile: the bar clamped in the CNC machine was moved forward by the length of the separated metal-cut projectile and the metal-cutting of the bar repeated with the next projectile.

A total of 17 lead projectiles were manufactured from the bar with the length of 300 mm. All projectiles were automatically measured with a measuring tool with the accuracy of 2 μm. All projectiles that were manufactured with the required tolerance ±0.005 mm, i.e. ±0.09% of diameter, were included in the compliant series. Projectiles whose measured deviations were higher, were discarded. In this specific production run, none projectile was discarded, which means that all of the 17 projectiles were included in the series. The measurement is provided in FIG. 3B.

Example 3B

Use of the Projectile According to Example 3A

The projectiles according to Example 3A were used for firing at a distance of 505 m, where lead projectiles pressed according to the state of the art, JSB KnockOut Slugs cal. 5.5 mm, weight 25,5 grains, which correspond 1,65 g and lead projectiles according to the present invention were compared. To compare the projectiles, one shooter with the same gas-operated weapon, the same target, the same distance and identical weather conditions were ensured. The target had the shape of a rectangle with the dimensions of 25×25 cm; a total of 10 shots were fired. The lead metal-cut projectiles as per Example 3A achieved 5 hits out of 10, i.e. 50% success rate. The tested pressed projectiles according to the state of the art achieved 1 hit out of 10, i.e. 10% success rate, which was rather coincidence than reproducible precision.

A significant benefit of the lead metal-cut bullets was in particular the considerably higher measured value of ballistic coefficient BC=0.22. The attained value of ballistic coefficient of the pressed projectiles was only BC=0.079. This means that the lead metal-cut projectiles ensured nearly 2.8 times lower side deviation with the same acting force of side wind.

Another advantage of the metal-cut projectiles compared to pressed ones was the weight and dimensional stability which ensured a very low measured standard deviation of the projectile muzzle ±0.3 m/s, that resulted in a height deviation from the aiming point of only ±4.94 cm on the target at a distance of 505 m. The employed pressed projectiles attained the standard deviation of muzzle speed ±0.9 m/s, which caused a difference in height on the target ±24.5 cm from the aiming point, which means that it was necessary to aim at the target that vertical size of which was at least 50 cm, i.e. twice the size, to allow its hitting by each shot in the ideal theoretical case (with no error of the shooter and with no effect of wind and other variables). Both types of projectile were fired at the same speed of 272 m/s.

The lead metal-cut projectiles thus provided the shooter with the possibility of theoretical hit by all shots unlike in the case of the lead pressed projectiles the parameters of which failed to provide even a theoretical possibility of hitting by all shots. Using common statistics and prediction, the probability of absolute missing the target was higher, if light wind was taken into account.

Example 4A

A total of 30 rotationally metal-cut projectiles of the caliber .17, i.e. 4.32 mm, for gas-guns were manufactured with the standard deviation of diameter ±0.005 mm, with the length 8.3 mm, with the standard deviation of length ±0.02 mm, with the weight per projectile 1.11 g, with the standard deviation of weight ±0.0012 g.

Figure 4:
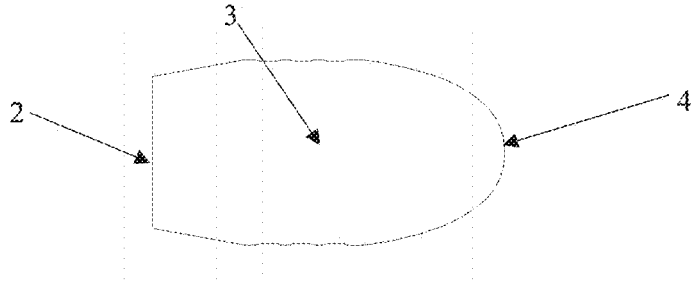
FIG. 4: A lead turned projectile 1 according to Example 4, 5, and 6 with three grooves, with a rounded face 4 and a flat back 2, where diameter of flat back 2 is smaller than diameter of a centre 3 of the projectile 1.

A bar with the length of 300 mm and with the diameter of 5 mm made of lead alloy comprising 98.5% by weight of lead and 1.5% by weight of cadmium was clamped into a collet on the mandrel of the CNC machine. The CNC machine was adjusted as follows: the revolutions of the mandrel were set at 1,200 revolutions per minute and the advance movement of metal-cutting was 90 mm/min. The metal-cutting process was programmed based on the curve provided in FIG. 4.

A cutter with a carbide plate and a cut-off blade made of high-speed steel with the blade thickness of 1 mm were fixed to the cutter support on the CNC machine. Then the CNC machine was started and the bar began to be metal-cut along the set path of the cutter, and/or the required shape of the projectile. After the first projectile was metal-cut, the projectile was separated from the bar by the cut-off tool. The projectile was then removed from the metal-cutting space and the process was repeated for the following projectile: the bar clamped in the CNC machine was moved forward by the length of the separated metal-cut projectile and the metal-cutting of the bar repeated with the next projectile.

A total of 30 lead projectiles were manufactured from the bar with the length of 300 mm. All projectiles were automatically measured with a measuring tool with the accuracy of 2 μm. All projectiles that were manufactured with the required tolerance ±0.005 mm, i.e. ±0.11% of diameter, were included in the compliant series. Projectiles whose measured deviations were higher, were discarded. In this specific production run, none projectile was discarded, which means that all of the 30 projectiles were included in the series.

Example 4B

Use of the Projectile According to Example 4A

The projectiles as per Example 4A were used for shooting at a distance of 205 m. The target had a circular profile with the diameter of 6 cm and one series of five shots was fired. The lead metal-cut projectiles as per Example 4A achieved 3 hits out of 5 shots. The achieved results could not be compared as projectiles for gas-operated guns/rifles with this caliber are not available.

Example 5

A total of 18 rotationally metal-cut projectiles of the caliber 0.30, i.e. 7.62 mm, for gas-guns were manufactured with the standard deviation of diameter ±0.005 mm, with the length 14.6 mm, with the standard deviation of length ±0.02 mm, with the weight per projectile 6.05 g, with the standard deviation of weight ±0.0035 g.

A bar with the length of 300 mm and with the diameter of 8 mm made of lead alloy comprising 98.5% by weight of lead and 1.5% by weight of copper was clamped into a collet on the mandrel of the NC machine. The NC machine was adjusted as follows: the revolutions of the mandrel were set at 2600 revolutions per minute and the advance movement of metal-cutting was 200 mm/min. The metal-cutting process was programmed based on the curve provided in FIG. 4.

A cutter with a carbide plate and a cut-off blade made of high-speed steel with the blade thickness of 0.8 mm were fixed to the cutter support on the CNC machine. Then the CNC machine was started and the bar began to be metal-cut along the set path of the cutter, and/or the required shape of the projectile. After the first projectile was metal-cut, the projectile was separated from the bar by the cut-off tool. The projectile was then removed from the metal-cutting space and the process was repeated for the following projectile: the bar clamped in the CNC machine was moved forward by the length of the separated metal-cut projectile and the metal-cutting of the bar repeated with the next projectile.

A total of 18 lead projectiles were manufactured from the bar with the length of 300 mm. All projectiles were automatically measured with a measuring tool with the accuracy of 2 μm. All projectiles that were manufactured with the required tolerance ±0.005 mm, i.e. ±0.065% of diameter, were included in the compliant series. Projectiles whose measured deviations were higher, were discarded. In this specific production run, none projectile was discarded, which means that all of the 18 projectiles were included in the series.

Example 6

A total of 15 rotationally metal-cut projectiles of the caliber 0.35, i.e. 9 mm, for gas-guns were manufactured with the standard deviation of diameter ±0.005 mm, with the length 17.3 mm, with the standard deviation of length ±0.02 mm, with the weight per projectile 10 g, with the standard deviation of weight ±0.0071 g.

A bar with the length of 300 mm and with the diameter of 10 mm made of lead alloy comprising 95% by weight of lead, 2.5% by weight of silver, and 2.5% by weight of nickel was clamped into a collet on the mandrel of the CNC machine. The CNC machine was adjusted as follows: the revolutions of the mandrel were set at 1,500 revolutions per minute and the advance movement of metal-cutting was 120 mm/min. The metal-cutting process was programmed based on the curve provided in FIG. 4.

A cutter with a carbide plate and a cut-off blade made of high-speed steel with the blade thickness of 1.5 mm were fixed to the cutter support on the CNC machine. Then the CNC machine was started and the bar began to be metal-cut along the set path of the cutter, and/or the required shape of the projectile. After the first projectile was metal-cut, the projectile was separated from the bar by the cut-off tool. The projectile was then removed from the metal-cutting space and the process was repeated for the following projectile: the bar clamped in the CNC machine was moved forward by the length of the separated metal-cut projectile and the metal-cutting of the bar repeated with the next projectile.

A total of 15 lead projectiles were manufactured from the bar with the length of 300 mm. All projectiles were automatically measured with a measuring tool with the accuracy of 2 μm. All projectiles that were manufactured with the required tolerance ±0.005 mm, i.e. 10.055% of diameter, were included in the compliant series. Projectiles whose measured deviations were higher, were discarded. In this specific production run, one projectile was discarded, which means that 14 projectiles were included in the series.

Example 7A

A total of 8 lead rotationally metal-cut projectiles of the caliber of .35, i.e. 9 mm designed for gas-guns, with the length of 30.3 mm were manufactured.

Figure 5A:
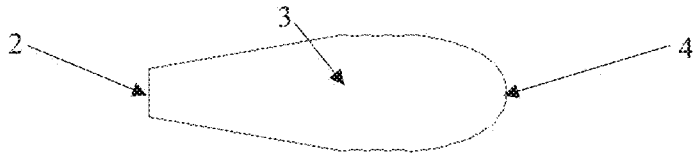
FIG. 5A: A lead turned projectile 1 according to Example 7A, with three grooves, with a rounded face 4 and a flat back 2, where diameter of flat back 2 is smaller than diameter of a centre 3 of the projectile 1.

A bar with the length of 300 mm and with the diameter of 10 mm made of lead alloy comprising 60% by weight of lead and 40% by weight of tin was clamped into a collet on the mandrel of the CNC machine and processed in two steps with the constant position of the bar along the curve provided in FIG. 5A. In step one, material was removed from the bar by the cutter to roughly form the required shape of the projectile—with tiny steps created on the bar. In step two, the rough shape of the projectile was finished to have the required shape of the projectile. After the first projectile was metal-cut, the projectile was separated from the bar by the cut-off tool, removed from the metal-cutting space and the process was repeated for the following projectile again in the position of the rotating bar in two steps.

All projectiles were automatically measured with a measuring tool with the accuracy of 2 μm. All projectiles that were manufactured with the required tolerance ±0.005 mm, i.e. ±0.055% of diameter, were included in the compliant series.

Example 7B

A total of 10 lead rotationally metal-cut projectiles of the caliber of .17, i.e. 4.5 mm designed for gas-guns, with the length of 19 mm were manufactured.

Figure 5B:
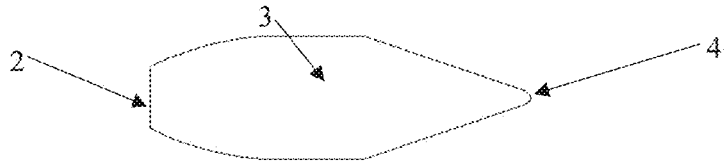
FIG. 5B: A lead turned projectile according to Example 7B, without grooves, with a pointed face 4 and a flat back 2, where diameter of flat back 2 is smaller than diameter of a centre 3 of the projectile 1.

A bar with the length of 300 mm and with the diameter of 5 mm made of lead alloy comprising 95% by weight of lead and 5% by weight of tin was clamped into a collet on the mandrel of the CNC machine and processed with the constant position of the bar along the curve provided in FIG. 5B. After the first projectile was metal-cut, the projectile was separated from the bar by the cut-off tool, removed from the metal-cutting space and the process was repeated for the following projectile again in the position of the bar.

All projectiles were automatically measured with a measuring tool with the accuracy of 2 μm. All projectiles that were manufactured with the required tolerance ±0.005 mm, i.e. ±0.11% of diameter, were included in the compliant series.

Example 7C

A total of 10 lead rotationally metal-cut projectiles of the caliber of .50, i.e. 12.7 mm designed for gas-guns, with the length of 28.7 mm were manufactured.

Figure 5C:
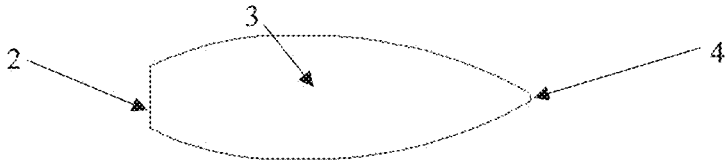
FIG. 5C: A lead turned projectile according to Example 7C, without grooves, with a pointed face 4 and a flat back 2, where diameter of flat back 2 is smaller than diameter of a centre 3 of the projectile 1.

A bar with the length of 300 mm and with the diameter of 13 mm made of lead alloy comprising 95% by weight of lead, 3% by weight of tin, and 2% by weight of antimony was clamped into a collet on the mandrel of the CNC machine and processed with the constant position of the rotating bar along the curve provided in FIG. 5C. After the first projectile was metal-cut, the projectile was separated from the bar by the cut-off tool, removed from the metal-cutting space and the process was repeated for the following projectile again in the position of the rotating bar.

All projectiles were automatically measured with a measuring tool with the accuracy of 2 μm. All projectiles that were manufactured with the required tolerance ±0.005 mm, i.e. ±0.039% of diameter, were included in the compliant series.

Example 7D

A total of 10 lead rotationally metal-cut projectiles of the caliber of .17, i.e. 4.32 mm designed for gas-guns, with the length of 8 mm were manufactured.

Figure 5D:
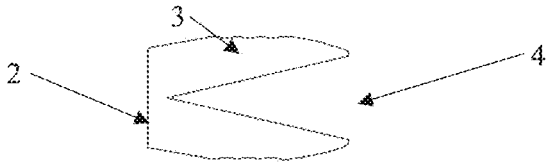
FIG. 5D: A lead turned projectile according to Example 7D, with three grooves, with a depression on a face 4 and a flat back 2, where diameter of flat back 2 is smaller than diameter of a centre 3 of the projectile 1.

A bar with the length of 300 mm and with the diameter of 5 mm made of lead alloy comprising 97% by weight of lead, 0.8% by weight of astatine, and 2.2% by weight of bismuth was clamped into a collet on the mandrel of the CNC machine and processed on the outer side with the constant position of the rotating bar along the curve provided in FIG. 5D. After the projectile was metal-cut, the projectile was directly in the CNC machine finalized from the front side by boring using a taper caliber fixed on the cutter support. After the first projectile was calibered, the projectile was separated from the bar by the cut-off tool, removed from the metal-cutting space and the process was repeated for the following projectile.

All projectiles were automatically measured with a measuring tool with the accuracy of 2 μm. All projectiles that were manufactured with the required tolerance ±0.005 mm, i.e. ±0.11% of diameter, were included in the compliant series.

Example 7E

A total of 10 lead rotationally metal-cut projectiles of the caliber of .22, i.e. 5.5 mm designed for gas-guns, with the length of 23 mm were manufactured.

Figure 5E:
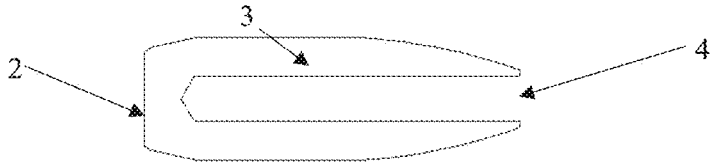
FIG. 5E: A lead turned projectile according to Example 7E, without grooves, with a depression on a face 4 and a flat back 2, where diameter of flat back 2 is smaller than diameter of a centre 3 of the projectile 1.
Figure 5F:
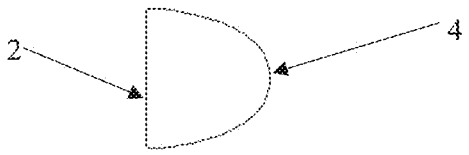
FIG. 5F: A lead turned projectile according to Example 7F, without, with a rounded face 4 and a flat back 2.

A bar with the length of 300 mm and with the diameter of 6 mm made of lead alloy comprising 99% by weight of lead, 0.4% by weight of iron, and 0.6% by weight of zinc was clamped into a collet on the mandrel of the CNC machine and processed on the outer side with the constant position of the rotating bar along the curve provided in FIG. 5E. After the projectile was metal-cut, the projectile was directly in the CNC machine finalized from the front side by boring using a cylindrical caliber. After the first projectile was calibered, the projectile was separated from the bar by the cut-off tool, removed from the metal-cutting space and the process was repeated for the following projectile.

All projectiles were automatically measured with a measuring tool with the accuracy of 2 μm. All projectiles that were manufactured with the required tolerance ±0.005 mm, i.e. ±0.09% of diameter, were included in the compliant series.

Example 7F

A total of 10 lead rotationally metal-cut projectiles of the caliber of .26, i.e. 6.5 mm designed for gas-guns, with the length of 6.6 mm were manufactured.

A bar with the length of 300 mm and with the diameter of 7 mm made of lead alloy comprising 99.5% by weight of lead and 0.5% by weight of titanium was clamped into a collet on the mandrel of the CNC machine and processed with the constant position of the rotating bar along the curve provided in FIG. 5E. After the first projectile was metal-cut, the projectile was separated from the bar by the cut-off tool, removed from the metal-cutting space and the process was repeated for the following projectile again in the position of the rotating bar.

All projectiles were automatically measured with a measuring tool with the accuracy of 2 μm. All projectiles that were manufactured with the required tolerance ±0.005 mm, i.e. ±0.076% of diameter, were included in the compliant series.

LIST OF MARKS FOR TERMS

1. projectile
2. back of the projectile 1
3. centre of the projectile 1
4. face of the projectile 1
5. central axis of the projectile 1

APPLICABILITY IN INDUSTRY

The lead metal-cut projectiles designed for gas-guns with a higher precision and a higher value of ballistic coefficient compared to pressed or cast projectiles.

The invention claimed is:

1. A method of manufacture of a rotationally symmetrical lead metal-cut turned projectile comprising a lead alloy comprising 99.8% by weight of lead, and 0.2% by weight of antimony wherein the projectile caliber is .22 and comprises a flat back and a rounded face, the method comprising:

clamping a bar made of the lead alloy into a collet on a mandrel of a machine-tool;

clamping a cutter and a cut-off tool on a cutter support of the machine-tool;

programming in the machine-tool a metal-cutting curve;

starting the machine-tool;

machining the bar made of lead alloy by the cutter as per the metal-cutting curve; and separating a machined projectile at said flat back by the cut-off tool.

2. The method of manufacture of the rotationally symmetrical lead metal-cut projectile according to claim 1, wherein the cutter or the cut-off tool is equipped with a blade made of carbide or a blade made of high-speed steel of CSN class 19.

3. The method of manufacture of the rotationally symmetrical lead metal-cut projectile according to claim 1, wherein the bar is rotating around its central axis and the cutter is moving in one plane, wherein the central axis is a part of this plane.

4. The method of manufacture of the rotationally symmetrical lead metal-cut projectile according to claim 1, wherein the cut-off tool blade thickness ranges between 0.4 and 1.5 mm.

* * * * *